United States Patent [19]

Colgan

[11] 4,384,233

[45] May 17, 1983

[54] TELEVISION CAMERA TUBE ASSEMBLY AND ELECTRICAL CONTACT FOR TARGET ELECTRODE

[75] Inventor: John J. Colgan, Haddon Heights, N.J.

[73] Assignee: RCA Corporation, New York, N.Y.

[21] Appl. No.: 243,392

[22] Filed: Mar. 13, 1981

[51] Int. Cl.[3] ..... H01J 5/50; H01J 31/38

[52] U.S. Cl. ..... 313/51; 313/384; 313/477 R; 335/210

[58] Field of Search ..... 313/440, 376, 378, 384, 313/390, 477, 477 HC, 51; 335/210; 174/50.52, 50.51

[56] References Cited

U.S. PATENT DOCUMENTS

| | | | |
|---|---|---|---|
| 3,766,425 | 10/1973 | Didde et al. | 315/10 |
| 3,857,037 | 12/1974 | Tomii et al. | 313/384 X |
| 4,191,936 | 3/1980 | Colgan, Jr. | 335/210 |

FOREIGN PATENT DOCUMENTS

| | | | |
|---|---|---|---|
| 52-48921 | 4/1977 | Japan | 313/390 |

*Primary Examiner*—Palmer C. Demeo

*Attorney, Agent, or Firm*—E. M. Whitacre; W. H. Meise

[57] ABSTRACT

Electrical contact with the target electrode of the tube in a tube/coil assembly is made by disposing a wire tangentially to a radial periphery about the longitudinal axis of the tube to create an interference fit between the wire and the electrode.

5 Claims, 6 Drawing Figures

TELEVISION CAMERA TUBE ASSEMBLY AND ELECTRICAL CONTACT FOR TARGET ELECTRODE

BACKGROUND OF THE INVENTION

Tube/coil assemblies are often utilized in the electronic arts, such as in a television camera. U.S. Pat. No. 4,191,936 relates to one such tube/coil assembly in a television camera and explains the basic structural aspects thereof. As mentioned in this patent, such tube/coil assemblies are usually of cylindrical shape and electrical contact must be made therein with a target electrode at one longitudinal end of the tube. The target electrode may either be a pin protruding from the end of the tube or a peripheral ring about the end of the tube. Schemes have been devised for making electrical contact with each type of target electrode. However, all of these schemes are either complex and therefore costly to implement or simplistic but difficult to accomplish especially when tubes are replaced in the assemblies. A functional problem is also encountered with any such electrical contact scheme in that it adds an undesired capacitance in the circuitry with which the tube-coil assembly is utilized.

SUMMARY OF THE INVENTION

To reduce the capacitance which results when making electrical contact with the target electrode in a tube/coil assembly, a wire is disposed in the assembly tangentially to a radial periphery about the longitudinal axis of the tube to create an interference fit with the electrode and thereby establish electrical contact thereagainst. Various embodiments of the invention are possible depending on the structural nature of the tube/coil assembly being utilized.

DESCRIPTION OF THE PREFERRED EMBODIMENTS

Figure 1:
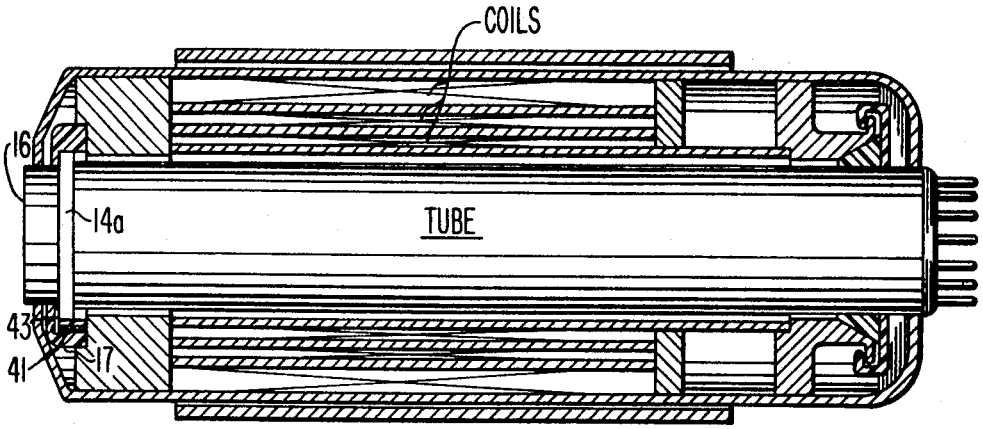
PRIOR ART Fig. 1
FIG. 1 illustrates the structural nature of a prior art tube/coil assembly having a tube with a ring type target electrode at one longitudinal end thereof.

A typical tube/coil assembly for a television camera is illustrated in FIG. 1 and the structural details for this assembly are disclosed in U.S. Pat. No. 4,191,936. The structural details of importance to this invention are that the electronic tube is mounted within cylindrically shaped coils and at one end of the tube a ring type target electrode 14*a* is disposed in close proximity to the transparent faceplate 16. Electrical contact with the electrode 14*a* must be provided and in FIG. 1 this is accomplished with the metal strap 43 which extends in a cantilevered fashion from the mounting clamp 17 to which it is affixed by a screw 41.

Figure 2:
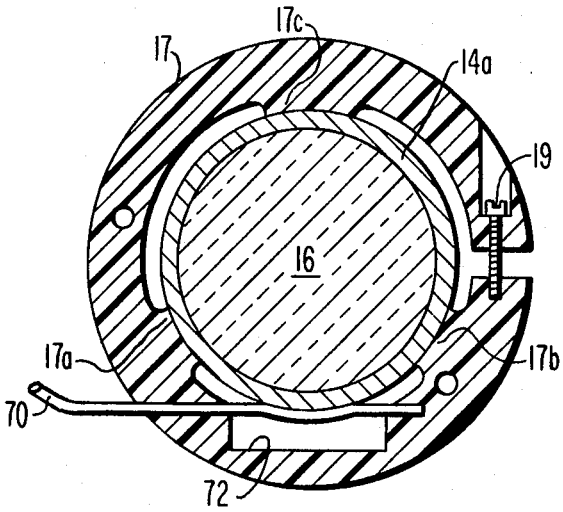
FIG. 2 is a sectional view across the longitudinal axis of a tube/coil assembly similar to that of FIG. 1 in which one preferred embodiment of the invention is illustrated.

Although this arrangement for providing the electrical contact may appear to be simple, it involves four individual parts. Consequently, problems relating to inventory of parts, dimensional tolerance buildups and assembly considerations combine to result in a measure of complexity. Furthermore, this arrangement adds undesired capacitance in the television camera circuitry, with such capacitance being in proportion to the cross sectional area and the length of the electrically conductive parts that are utilized. In one actual tube/coil assembly having the structural details of FIG. 1, the metal strip 43 is made of flat stock having a cross sectional area per inch of length equal to 0.001 square inches. As illustrated in FIG. 2, the tube/coil assembly of FIG. 1 could be modified to incorporate the electrical contact of this invention in which a wire 70 is disposed therein tangentially to a radial periphery about the longitudinal axis of the tube to create an interference fit with the electrode 14*a* and thereby establish electrical contact thereagainst. As an example of how the capacitance is decreased by the electrical contact arrangement of FIG. 2, a cross-sectional area per inch of wire length equal to 0.0003 square inches would be encountered when wire having a diameter of 0.020 inch is utilized.

Figure 4:
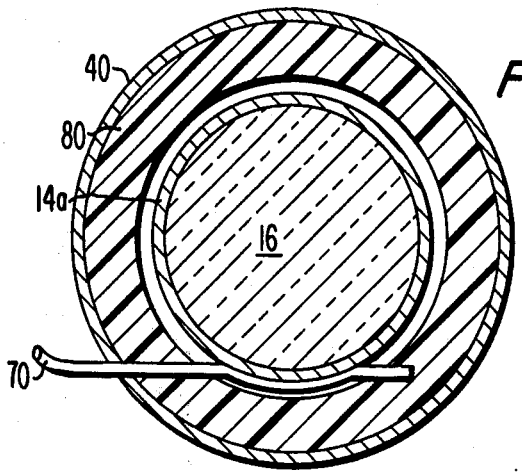
FIG. 4 is a sectional view across the longitudinal axis of the FIG. 3 tube/coil assembly in which another preferred embodiment of the invention is illustrated.

Those skilled in the art should need no further explanation to understand how the interference fit between the electrode 14*a* and the wire 70 is derived in FIG. 2. However, to explain this further, FIG. 2 is the same as FIG. 4 in U.S. Pat. No. 4,191,936 except that modifications were made to show the interference fit between the electrode 14*a* and the wire 70 rather than the screw 41. The wire 70 is disposed through the outer cylindrical surface of the clamp 17 to pass through a relief notch 72 in the inner cylindrical surface thereof and is distorted by the electrode 14*a* to establish the electrical contact therebetween. Consequently, the wire 70 would first be disposed in the clamp 17 before the faceplate 16 of the tube is inserted through the clamp 17. The wire 70 passes into the mounting clamp 17 through an appropriately sized clearance hole for the wire gauge selected and the distortion of it by the electrode 14*a* at the interference fit retains the wire 70 in the tube/coil assembly. To properly locate the wire 70 prior to its being distorted, the clearance hole passes through the sidewall of the clamp 17 into the relief notch 72 and then is resumed into that sidewall. The adjustable screw 19 is only shown to facilitate the analogy with the clamp arrangement of FIG. 4 in U.S. Pat. No. 4,191,936 and it is known to be unnecessary for some versions of the mounting clamp 17 in tube/coil assemblies of the type shown in FIG. 1. Furthermore, the contact numbers 17*a*, 17*b* and 17*c* are also unnecessary in some versions of the mounting clamp 17 and in some embodiments of the invention no mounting clamp 17 would be utilized.

Figure 3:
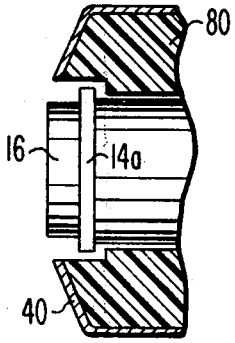
FIG. 3 illustrates the structural nature of another tube/coil assembly.

In tube/coil assemblies which have no mounting clamp 17 at the faceplate 16 end of the tube, a significant clearance space exists in the region around the electrode 14*a* as is illustrated in FIG. 3 where only a portion of the tube/coil assembly is shown. The electronic shield 40 usually extends for the total length of the tube and it is provided with structural support where necessary by an insulated spacer 80. The wire 70 in such tube/coil assemblies may be directed through the shield 40 and spacer 80 and be distorted into the clearance space by its interference fit with the electrode 14*a*, as shown in FIG.

4. Of course, the tube/coil assembly could have many other structural arrangements wherein the wire 70 would be disposed tangentially to a radial periphery about the longitudinal axis of the tube to create an interference fit with the electrode 14*a* and thereby establish electrical contact thereagainst.

Figure 5:
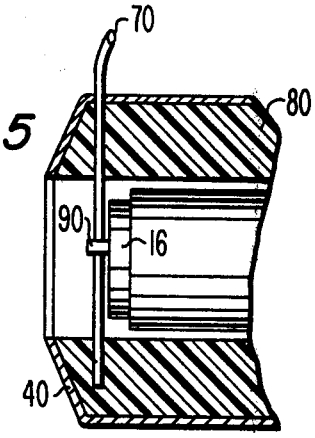
FIGS. 5 and 6 illustrate the structural nature of still another tube/coil assembly with still another preferred embodiment of the invention incorporated therein.
Figure 6:
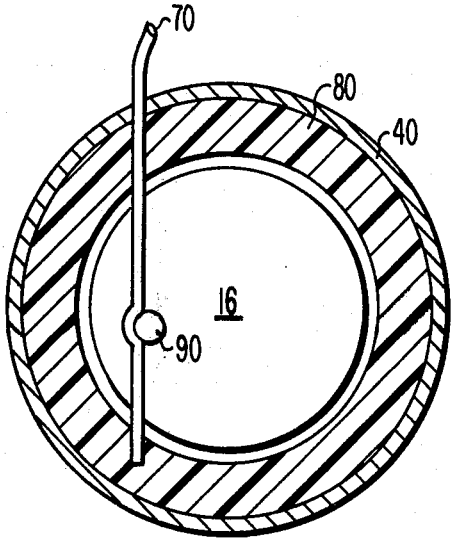

The electrical contact of this invention can also be utilized in a tube/coil assembly which includes a tube with a pin type target electrode. One such tube/coil assembly is shown in FIGS. 5 and 6. The structural aspects of this assembly are substantially the same as the tube/coil assembly illustrated in FIG. 4, except that the target electrode of the tube is a pin 90 which extends from the faceplate 16 of the tube. The wire 70 in this assembly is directed through the shield 40 and spacer 80, so as to pass over the faceplate 16 at a location tangent to a radial periphery about the longitudinal axis of the tube to create an interference fit with the pin 90 and thereby establish electrical contact thereagainst. The wire 70 is disposed in the assembly before the tube is located therein and it is distorted by the pin 90 to establish the electrical contact when the tube is located in the assembly. Although the wire 70 could be distorted in a direction parallel to the longitudinal axis of the tube, it is distorted to one side of the pin 90 as shown in FIG. 6. Furthermore, a lead (not shown) could be disposed on the end of the pin 90 to direct the wire 70 to the side of the pin 90.

What I claim is:

1. In a television camera tube assembly for an elongated tube of the type including a target electrode at one longitudinal end thereof and an electrical contact coupled to said target electrode, and electrode contacts at the other end thereof for connection to electrodes other than the target, said tube assembly further including cylindrically shaped magnetic coils surrounding at least a portion of said tube, and a tube mounting, the improvement comprising:

a wire disposed in the tube mounting of said assembly in an attitude tangential to a radial periphery about the longitudinal axis of said elongated tube at a radius to create an interference fit with said electrical contact coupled to said target electrode and thereby establish electrical contact thereagainst.

2. The assembly of claim 1 wherein said tube includes a ring type contact coupled to said target electrode and said tube mounting includes a ring shaped mounting clamp of electrical insulating material securing the target electrode end of said tube, said wire being passed through the outer surface of said clamp and through a relief notch in the inner cylindrical surface thereof, said clamp being configured to have the tube end target electrode pass therethrough with said wire being distorted into said relief notch by said electrical contact coupled to said target electrode to establish the electrical contact.

3. The assembly of claim 1 wherein a clearance space is provided about the peripheral surface of the target electrode, said wire being passed through said clearance space and distorted thereinto by the target electrode to establish the electrical contact.

4. The assembly of claim 1 wherein said electrical contact to said target electrode includes a longitudinally oriented pin and said wire passes across the pin at a location where said wire is distorted by said pin to establish the electrical contact therebetween when the tube is disposed in the assembly.

5. The assembly of claim 4 wherein the wire is distorted to one side of the pin.

* * * * *